United States Patent [19]

Eigenmann

[11] Patent Number: 4,681,480

[45] Date of Patent: Jul. 21, 1987

[54] METHOD FOR FORMING ROADWAY-MARKING MEANS WHEREBY INDIVIDUAL RETROREFLECTING ELEMENTS ARE GATHERED AND GROUPED TOGETHER

[76] Inventor: Ludwig Eigenmann, Via Dufour3, CH 6900 Lugano, Switzerland

[21] Appl. No.: 888,314

[22] Filed: Jul. 22, 1986

[30] Foreign Application Priority Data

Jul. 23, 1985 [CH] Switzerland ..... 3199/85

[51] Int. Cl.[4] ..... E01F 9/08

[52] U.S. Cl. ..... 404/14; 404/94; 404/73; 427/137; 198/446; 221/156

[58] Field of Search ..... 404/6, 9, 14–16, 404/72, 73, 93, 94; 221/156, 171; 198/394, 425, 445, 446; 427/137

[56] References Cited

U.S. PATENT DOCUMENTS

| | | | |
|---|---|---|---|
| 2,268,538 | 12/1941 | Rodli et al. | 427/137 X |
| 2,380,910 | 7/1945 | Newton | 198/446 X |
| 2,788,882 | 4/1957 | Swartz et al. | 198/446 |
| 3,746,425 | 7/1973 | Eigenmann | 404/14 X |
| 3,823,815 | 7/1974 | Bretten et al. | 198/445 X |
| 4,072,403 | 2/1978 | Eigenmann | 404/6 X |
| 4,279,534 | 7/1981 | Eigenmann | 404/72 |
| 4,288,487 | 9/1981 | Eigenmann | 404/9 X |
| 4,322,177 | 3/1982 | Eigenmann | 404/93 X |

*Primary Examiner*—Stephen J. Novosad
*Assistant Examiner*—John F. Letchford
*Attorney, Agent, or Firm*—David H. Semmes; Warren E. Olsen

[57] ABSTRACT

A method is described whereby asymmetric retroreflecting elements are positioned with their hemispherical sides pointing upwards, made to agglomerate in rows and then deposited onto the road surface or onto a road-marking strip.

2 Claims, 4 Drawing Figures

METHOD FOR FORMING ROADWAY-MARKING MEANS WHEREBY INDIVIDUAL RETROREFLECTING ELEMENTS ARE GATHERED AND GROUPED TOGETHER

DESCRIPTION

This invention concerns a method for obtaining the agglomeration of asymmetric retroreflecting elements and subsequent depositing of these elements onto a strip of polyurethane used for roadway surface marking.

In the Patent Application No. 25381 A/78, filed in Italy on July 5, 1978, and in its corresponding Patent granted in the United States of America U.S. Pat. No. 4,279,534, a method was claimed whereby asymmetric retroreflecting elements were oriented in such a way as to make them take a position with their flat sides resting against the road, on a roadway marking strip when deposited thereon during the making of said strip. This resulted in the rounded part of the elements projecting from the roadway-marking strip, providing a retroreflecting efficiency giving the excellent optical results claimed in the Italian Pat. No. 1.063.428 and in the corresponding Patent granted in the United States of America U.S. Pat. No. 4,072,403. In the aforesaid Application No. 25381 A/78 and in the U.S. Pat. No. 4,279,534, the orientation of the elements was obtained by allowing the elements to advance on a vibrating inclined plane, with obstacles being provided (ref. No. 70, FIG. 3 of aforesaid U.S. Pat. No. 4,279,534) designed to turn over the elements coming from the hopper that were not already resting with their flat sides against the inclined plane, so that all the elements were oriented with their rounded side pointing upwards.

A surprising discovery was made when it was noted that these straightening obstacles were not strictly necessary. By making the vibrating inclined plane of the appropriate length and setting it at the proper angle, a very high percentage of the retroflecting elements automatically takes the correct orientation to amply satisfy the practical requirements.

The explanation for this is that the elements that fall onto the inclined plane with their rounded sides pointing downwards take an orientation that is unstable, due to the almost point contact between their rounded surfaces and the surface of the plane. The vibration, therefore, makes most of them turn over to take the more stable orientation with their flat sides against the surface of the plane. All these stable elements maintain this orientation, and the vibration only causes them to advance down the plane. It was also discovered that if these correctly oriented elements—the ones oriented with their rounded sides pointing upwards—are made to travel down the vibrating inclined plane against or along an obstacle, they can group together in such a way that, with the subsequent depositing of these elements onto the roadway surface, a distribution of elements is obtained that provides many advantages, both as regards optical efficiency and the service life of the roadway marking.

In fact, the retroreflecting elements in the first row, which is first contacted by the oncoming traffic, although subjected to an amount of wear, protect the following rows from such severe wear, thus allowing their optical efficiency to remain undiminished for a long period of time. Furthermore, the fact that there are several rows of retroreflecting elements grouped together provides much greater optical efficiency than if they were not grouped in this manner.

This optical efficiency and the aforesaid wear protection afforded by this grouping are not diminished appreciably if the rows do not happen to be perfectly aligned and a small percentage of the elements are not correctly oriented, The agglomerated rows of elements can be formed and deposited either transversally to the direction of the road, or in the same direction of it, as described in detail further on.

Figure 1:
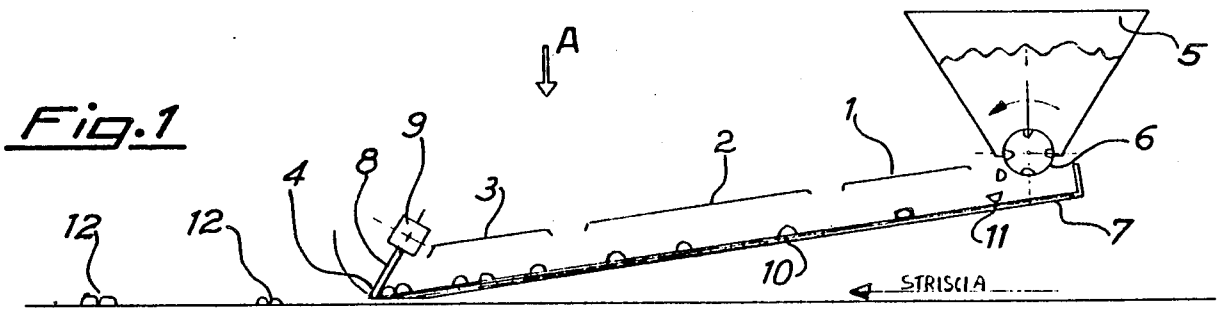
FIG. 1 shows a side view of the vibrating inclined plane.

In FIG. 1, the retroreflecting elements contained in the hopper (5) are delivered by the grooved roller (6) to the vibrating inclined plane in a mixed-oriented condition (1). At position (2), the incorrectly oriented elements become oriented correctly, with their round sides pointing upwards. At position (3), the elements become closely grouped together, and at position (4) the formed agglomeration of elements is deposited, either by the swinging up of the gate (8) around the axis (9), or by any other means.

The elements grouped together, as described above, are generally deposited onto a marking strip during its manufacture, the surface of the strip being covered with an appropriate adhesive material; the elements become therefore anchored on the strip, in rows 12 where the elements are strictly in a mutual contact.

Another method provides for depositing of elements of this type directly onto the road surface, prepared by a suitable painting; in this case the elements are usually smaller in size.

Figure 3:
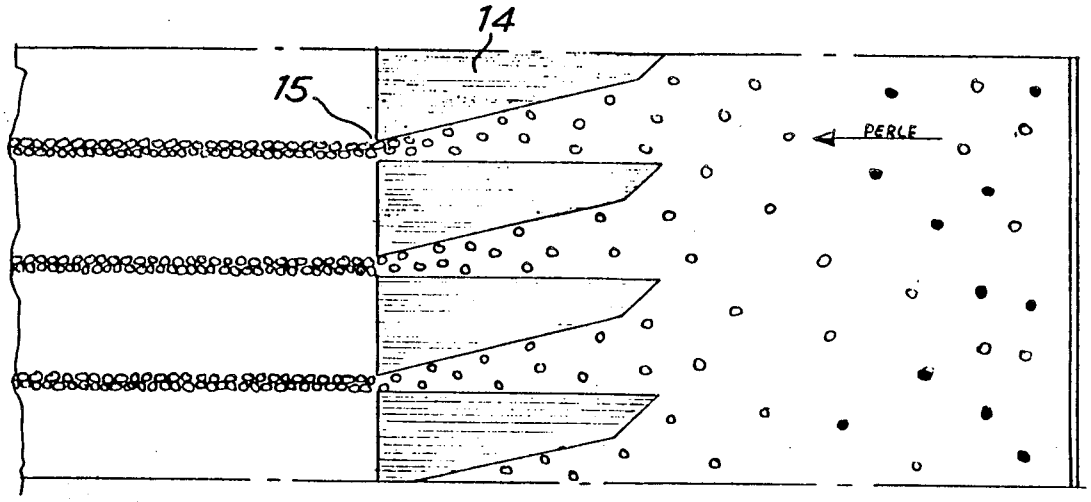
FIG. 3 shows an alternate inclined-plane configuration, for depositing the rows in the direction of the road.

FIG. 3 shows the modifications made to the vibrating inclined plane for obtaining longitudinal rows of elements; to this purpose there are foreseen wedge-shaped walls (14) which direct the elements to the deposit openings (15).

Figure 4:
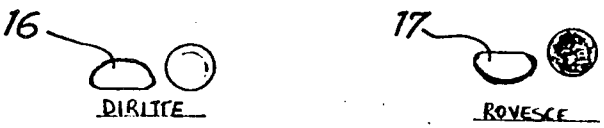
FIG. 4 shows the correct element orientation (16) and the incorrect orientation (17).

In FIG. 4, the element (16) is already in the correct position, whereas the element (17) has to be turned over to be in the correct position.

Figure 2:
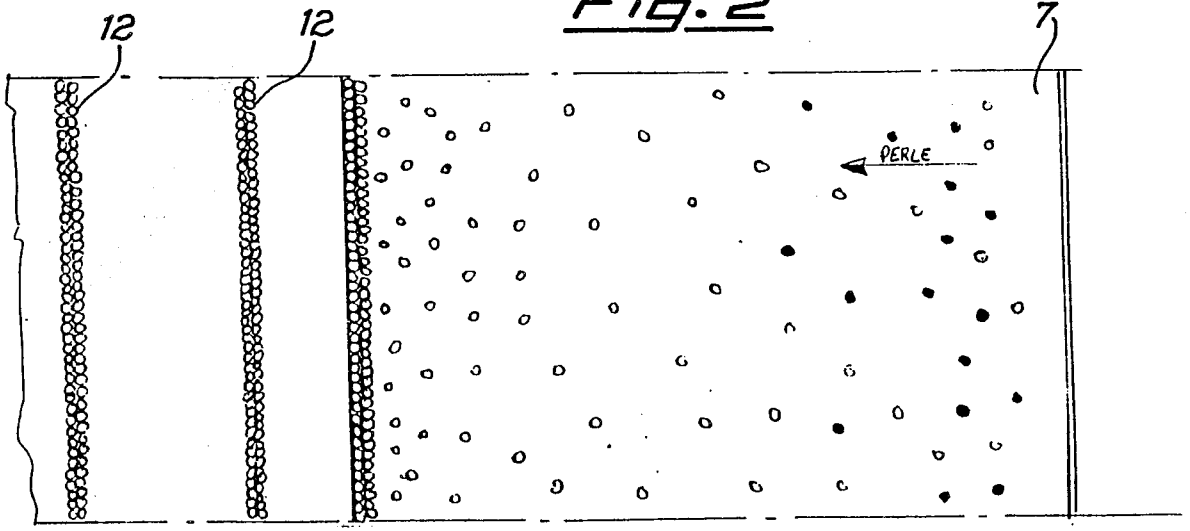
FIG. 2 is a plan view of the plane, showing also rows of elements deposited on the road.

There are two adjacent rows of elements in each of the deposited groups shown in FIGS. 1, 2 and 3. To increase the number of rows, the gate (8) needs only to be appropriately held open the time required to obtain a higher number of rows.

In FIG. 3, the opening (15) needs only to be appropriately sized to obtain a higher number of rows.

The method described in this invention has the advantage of providing a highly-efficient, continuous road-marking, within the dimensional limits of the available production equipment, with the further advantage of the technique of the "platelets", as described in the Italian Patent Application No. 22934 A/82, filed on Aug. 23, 1982, where the grouped retroreflecting elements are in form of "platelets".

The continuous road marking permits spacing the retroreflecting rows further apart, which is advantageous as regards daytime visibility of the road marking.

I claim:

1. A method for laying down of asymmetrical retroreflecting elements having flat sides and rounded sides upon roadway surface markings, comprising:

(a) moving said retroreflecting elements downwardly upon a vibrating inclined plane towards a depositing point such that a very high percentage of said elements is oriented with their rounded sides pointed upwardly and their flat sides against the inclined plane;

(b) during said moving downwardly, shifting and grouping the retroreflecting elements closer together, so as to provide the maximum number of mutual contacts between the individual retroreflecting elements; and (c) sequentially of said shifting and grouping, laying down a pre-established number of transversely extending rows that have been grouped together.

2. A method for laying down of asymmetrical retroreflecting elements having flat sides and rounded sides upon roadway surface markings, comprising:

(a) moving said retroreflecting elements downwardly upon a vibrating inclined plane towards a depositing point such that a very high percentage of said elements is oriented with their rounded sides pointed upwardly and their flat sides against the inclined plane;

(b) during said moving downwardly, shifting obliquely and grouping the retroreflecting elements together, so as to provide the maximum number of mutual contacts between the individual retroreflecting elements; and (c) sequentially of said shifting and grouping, laying down a pre-established number of longitudinally extending rows that have been grouped together.

* * * * *